US005829179A

United States Patent [19]

Carter et al.

[11] Patent Number: 5,829,179

[45] Date of Patent: Nov. 3, 1998

[54] TAMPER RESISTANT TRIGGER BLOCKING DEVICE

[76] Inventors: Robert L. Carter, 3124 Brossman Ct., Naperville, Ill. 60564; George W. Carter, Jr., 5300 Walnut La., Colleyville, Tex. 76034

[21] Appl. No.: 897,701

[22] Filed: Aug. 1, 1997

Related U.S. Application Data

[63] Continuation-in-part of Ser. No. 853,941, May 9, 1997, which is a continuation-in-part of Ser. No. 584,459, Jan. 11, 1996, Pat. No. 5,640,860.

[51] Int. Cl.[6] ..... F41A 17/00

[52] U.S. Cl. ..... 42/70.07; 42/70.11

[58] Field of Search ..... 42/70.07, 70.11; 70/25, 68, 23

[56] References Cited

U.S. PATENT DOCUMENTS

| | | | |
|---|---|---|---|
| 1,141,827 | 6/1915 | Reidt | 70/25 |
| 1,181,790 | 5/1916 | Newman | 70/25 |
| 2,503,953 | 4/1950 | Lind | 42/70 |
| 2,505,227 | 4/1950 | Charters | 42/70 |
| 2,512,140 | 6/1950 | Childs et al. | 42/70 |
| 2,859,551 | 11/1958 | Buchanan | 42/1 |
| 3,360,880 | 1/1968 | Finnegan | 42/66 |
| 3,637,180 | 1/1972 | Parry | 248/203 |
| 3,720,014 | 3/1973 | Goodrich | 42/1 N |
| 4,723,370 | 2/1988 | Sheehan | 42/70.07 |
| 4,821,539 | 4/1989 | Steinback | 70/68 |
| 4,999,940 | 3/1991 | Madden | 42/70.11 |
| 5,535,605 | 7/1996 | Werner | 70/14 |

*Primary Examiner*—Charles Jordan
*Assistant Examiner*—Meena Chelliah
*Attorney, Agent, or Firm*—Dillis V. Allen, Esq.

[57] ABSTRACT

A tamper resistant trigger blocking device for weapons having a trigger guard featuring a pair of blocking members that cover the opposite sides of the trigger guard preventing entry into the trigger area. The two blocking members are clamped together by a pair of oppositely disposed combination locks each of which has a plunger in the other blocking member that is grasped by the combination locks. Movement of the blocking members in the plane of the trigger guard is minimized by a plurality of indexible rods in one of the blocking members that are engageable with both sides of the trigger guard to prevent that movement. The user adjusts the positions of these rods to fit the user's trigger guard size and shape.

15 Claims, 7 Drawing Sheets

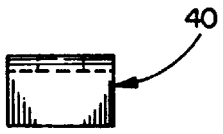
Fig. 14
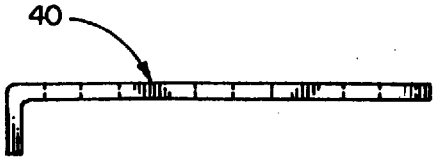
Fig. 15
Fig. 16
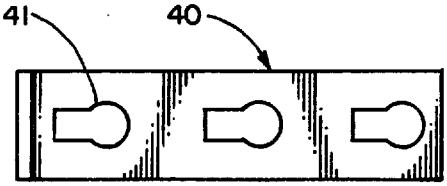
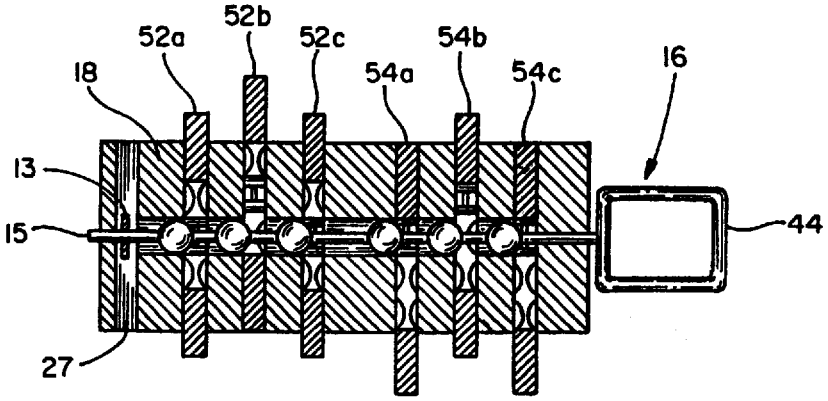
Fig. 17
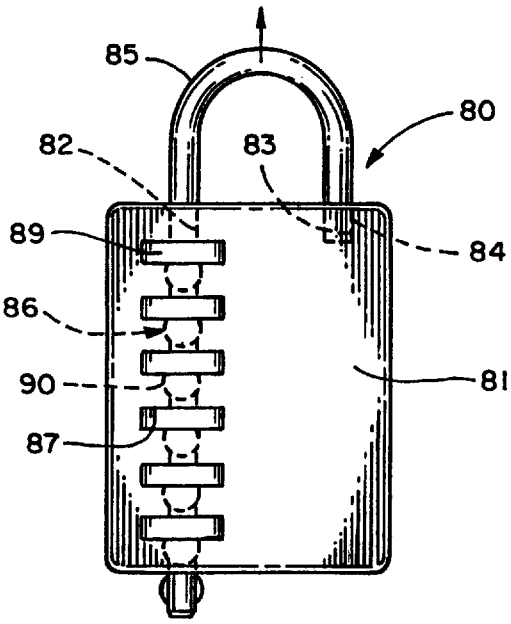
Fig. 18

TAMPER RESISTANT TRIGGER BLOCKING DEVICE

RELATED APPLICATIONS

This application is a Continuation-in-Part of our U.S. Ser. No. 08/853,941, Filed: May 9, 1997 entitled "TAMPER RESISTANT COMBINATION LOCK", which is a Continuation-in-Part of our U.S. Ser. No. 08/584,459, Filed: Jan. 11, 1996, entitled "TAMPER RESISTANT COMBINATION LOCK", now U.S. Pat. No. 5,640,860, Issued: Jun. 24, 1997.

BACKGROUND OF THE INVENTION

Various types of weapons, including revolvers, automatic and semi-automatic pistols, rifles, and shotguns, and some less popular weapons such as fishing spearguns, usually are provided with safety mechanisms that prevent trigger actuation until a safety member is pressed or shifted to enable trigger movement. These devices are primarily intended to prevent inadvertent triggering while in the user's hands during hunting or cleaning. These safety mechanisms, however, have no tamper proof characteristics, and are not intended to, that will prevent or at least hinder a child or any person, from firing the weapon because these prior safeties are exposed and may be actuated by any person with a simple finger On-Off shifting motion of a button or lever. There have, however, in the past been provided several attractive trigger blocking devices for limiting access to the trigger area using covers clamped over the trigger area that permit removal of these covers only by activating an integral locking device. One such locking cover device is manufactured by CCL Security Products, Inc. named Gun Blok™ that utilizes a plurality of combination lock rings similar to those found on brief cases. This design is exemplified in U.S. Pat. No. 4,499,681.

The principal problem in these prior blocking devices is they are difficult for the weapon owner to open with ease, particularly at dark or night fall, and quite easy for the unauthorized to open easily with skill at a professional thief level.

The brief case type multiple ring combination lock, while possibly suitable for brief cases, provides inadequate security for a trigger blocking device. Single ring combination locks are also unsuitable for this purpose because they cannot be operated by the authorized user in the dark or night fall.

In our U.S. patent application, Ser. No. 08/853,941, Filed: May 9, 1997, and in its parent application, U.S. Ser. No. 08/584,459, Filed: Jan. 11, 1996, we describe and claim a Tamper Resistant Combination Lock that includes a housing having a through bore receiving a locking plunger with a plurality of integral spaced obstructions thereon, the housing having a plurality of transverse slots each receiving one of two identical blocking slides that snap between three distinct positions, one passing the obstructions and plunger, and two blocking the obstructions and plunger. Lock picking is minimized by flexible fingers in the slides that engage the plunger obstructions when the slides are in the plunger passing position to simulate the slide blocking positions as the lock picker tugs the plunger.

A preliminary patent search in that application yielded the following collection of United States patents: Enholm, U.S. Pat. No. 428,387; Battershell, U.S. Pat. No. 1,733,772; Legat, U.S. Pat. No. 1,898,974; Ponder, U.S. Pat. No. 2,740,530; Nemsky, U.S. Pat. No. 3,155,230; Esquibel, et al., U.S. Pat. No. 3,514,981; Feinberg, U.S. Pat. No. 3,597, 945; Pedro, U.S. Pat. No. 3,865,166; Jones, Re. 30,139; Ippolito, et al., U.S. Pat. No. 4,187,703; Gordon, U.S. Pat. No. 4,463,847; Terada, et al., U.S. Pat. No. 5,081,855; Jarboe, U.S. Pat. No. 5,125,661; and Blanchard, U.S. Pat. No. 5,322,200.

The Ippolito, et al., U.S. Pat. No. 4,187,703, shows a locking system applied to an envelope defined by a pair of spaced plates, holding a numismatic coin. The Ippolito device has a slide plate 14 with cross slots 16 transversely positioned away from a central longitudinal slot 18. The transversely movable slides are all identical and can be positioned either in a right-hand or left-hand orientation as seen in FIG. 9. This arrangement, however, produces only two positions for each switch and, therefore, yields few combinations.

The Jarboe, U.S. Pat. No. 5,125,661, discloses a plunger-type locking mechanism, but there is really no logic in the lock combination because if all the plungers are depressed, the plunger 19 can be removed regardless of the position of blocks 35. Thus, it is not really a true combination lock at all.

The Esquibel, et al., U.S. Pat. No. 3,514,981, discloses a plunger-type locking mechanism for a box wherein a locking bar 14 is held or released by a plurality of slide bars 13 that have second slots 30 all positioned the same distance from the inner ends of the bars, and first slots 29 positioned in varying locations to correspond to one of the indicia on area 33 of the projecting ends of the bars 13. When the bars are slid to the appropriate indicia, the slots 29 permit the release of bars 14. The Esquibel, et al. lock has a total of only 48 combinations possible with five bars 13.

There is, however, no suggestion in this prior art as to how these prior combination lock mechanisms may be incorporated into a trigger blocking device and to that end the present application is directed.

Furthermore, in our U.S. application Ser. No. 08/584,459, and in our U.S. application Ser. No. 08/853,941, a combination lock is described that is not entirely suitable for trigger blocking devices because the number of combination slides should be over four and preferably six, and this design requirement would result in the lock projecting from the weapon at least 1.5 inches, making the weapon difficult to store or case in this condition. The combination slides can be reduced to 2 to minimize this problem, but then a two slide combination lock with three or less indexible positions is much easier to pick.

It is a primary object of the present invention to provide a tamper resistant blocking device that ameliorates the above problems in our prior United States patent applications and in the prior art relating to trigger blocking mechanisms by providing an improved tamper resistant locking device.

SUMMARY OF THE PRESENT INVENTION

In accordance with the present invention, a tamper resistant trigger blocking device is provided for weapons having trigger guards. This blocking device features a pair of blocking members that cover the opposite sides of the trigger guard preventing entry into the trigger area by unauthorized persons. The two blocking members are clamped together on the opposite sides of the trigger guard by a pair of oppositely disposed combination locks each of which has a plunger fixed to the other blocking member that extends into the lock that is grasped and pulled by each combination lock.

Movement of the blocking members in the plane of the trigger guard is minimized by a plurality of indexible rods in one blocking member that are engageable with both sides of the trigger guard. The user adjusts the positions of these rods to fit the user's trigger guard size and shape.

In the design of this new trigger blocking device, we have in essence adapted and altered the tamper resistant combination lock in our U.S. Ser. No. 08/584,459, and our U.S. Ser. No. 08/853,941, to accommodate the geometry of the trigger blocking device and to make it more suitable for that purpose. Toward these ends, we provide two combination locks, one on each of the blocking members that have three, rather than six, blocking slides. In this way the projection of the combination locks are minimized to facilitate casing, storing and transporting the weapon with the trigger blocking device in situ. It is necessary that the trigger blocking device be held securely against the sides of the trigger guard and toward that end the plungers in each of the trigger blocking members are axially adjustable by threading in and out so the blocking slides tension the plungers and pull the blocking members against the sides of the trigger guard.

Other objects and advantages of the present invention will appear more clearly from the following detailed description.

BRIEF DESCRIPTION OF THE PREFERRED EMBODIMENTS

FIG. 14 is an end view of the L-shaped housing slide connector;

FIG. 15 is a side view of the connector illustrated in FIG. 14;

FIG. 16 is a bottom view of the connector illustrated in FIGS. 14 and 15;

FIG. 17 is a longitudinal section of the present tamper resistant lock with all six blocking slides shown in various positions;

FIG. 18 is an alternative form of the present tamper resistant lock shown and exemplified in a padlock-type lock;

DETAILED DESCRIPTION OF THE PREFERRED EMBODIMENTS

The following is a reiteration of the text of our U.S. application Ser. No. 08/584,459, Filed: Jan. 11, 1996, with the understanding that the present tamper resistant trigger locking device illustrated in FIGS. 25 to 30 herein, incorporates the indexible slide technology, the obstruction styled plunger technology illustrated in FIGS. 1 to 24, and hence not shown in detail in FIGS. 25 to 30, and this text is also presented herein because the present application is a Continuation-in-Part of this prior application and thus entitled to the benefits of the filing dates of our above-noted applications for common subject matter.

Figure 1:
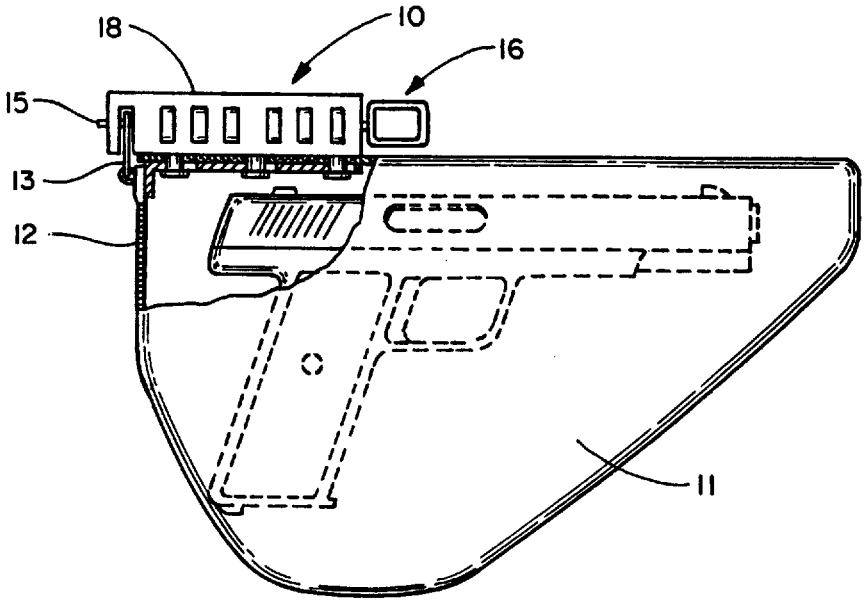
FIG. 1 is a side view of a flexible pistol case with the present tamper resistant combination lock fastened to its upper surface holding its zipper tang in a locked position with part of the fabric broken away near the lock mounting.
Figure 2:
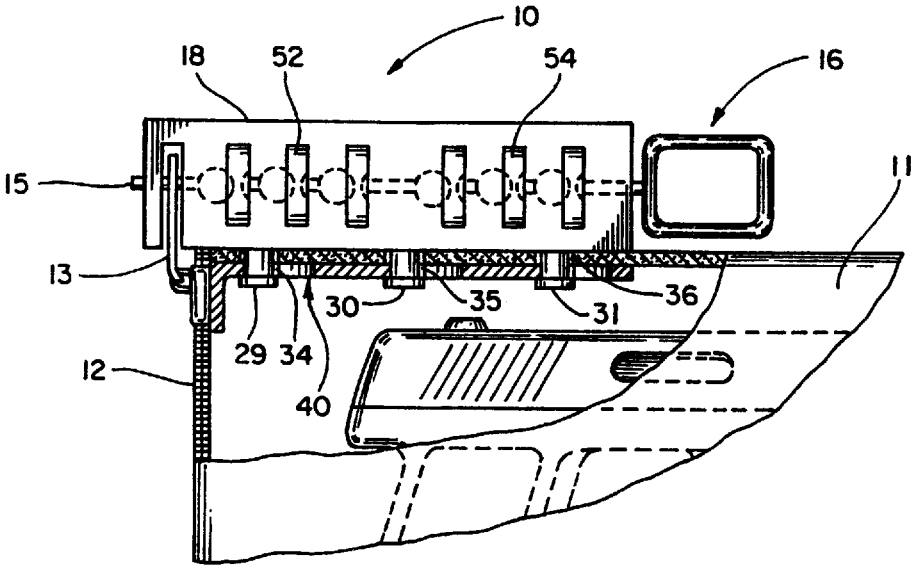
FIG. 2 is an enlarged fragmentary view of FIG. 1 showing the present tamper resistant combination lock and illustrating its manner of connection to the pistol case.

Referring to the drawings and particularly FIGS. 1 and 2, the present tamper resistant combination lock assembly 10 is illustrated attached to a flexible pistol case 11 having a peripheral zipper 12 and a pivotal zipper tang 13 having a conventional aperture there-through held in a locked position by distal end 15 of a locking plunger 16 forming part of the combination lock 10.

As seen in FIGS. 3, 4, and 11 to 13, the lock housing 18 is seen to be generally rectangular in configuration and may be constructed of a one piece plastic molding. A central bore 20 extends longitudinally through the housing and it is intersected by six blocking slide receiving transverse slots 21, 22, 23, 24, 25 and 26. Note the configuration of the slots and bore shown in fragmentary form in FIG. 4. An additional end slot 27 is provided for receiving zipper tang 13.

Figure 11:
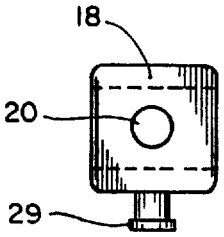
FIG. 11 is an end view of the lock housing.
Figure 12:
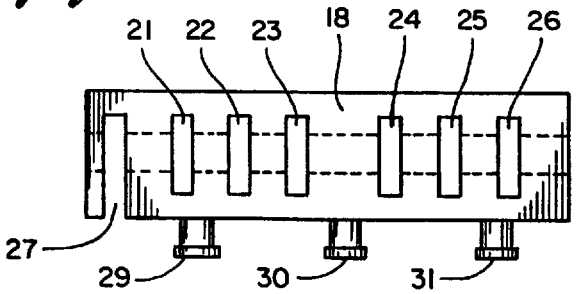
FIG. 12 is a side view of the lock housing.
Figure 13:
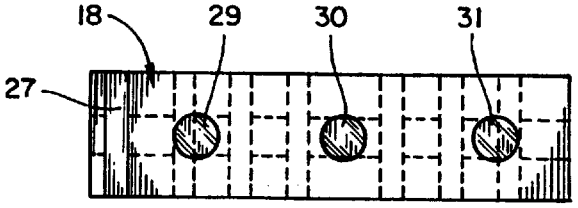
FIG. 13 is a bottom view of the lock housing.

As seen in FIGS. 11 and 12, the housing has three integral headed projections 29, 30, 31 extending downwardly therefrom that are designed to pass through apertures 34, 35 and 36 in the top wall of the pistol case 11. A key-hole type L-shaped connector 40 illustrated clearly in FIGS. 14, 15 and 16 has three key-hole type apertures 41 that receive the headed projections 29, 30 and 31 to lock the housing 18 and the lock 10 to the pistol case 11 in its appropriate position.

Figure 9:
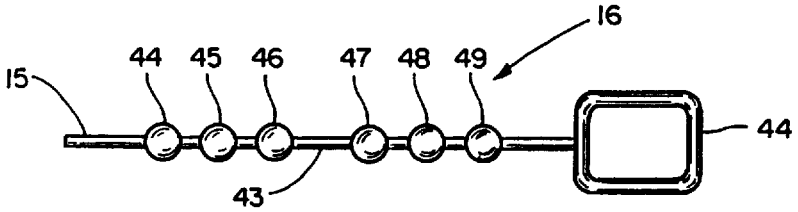
FIG. 9 is a sub-assembly view of the locking plunger.
Figure 10:
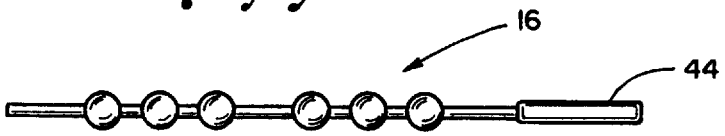
FIG. 10 is an orthogonally rotated view of the locking plunger illustrated in FIG. 9.

As seen in FIGS. 9 and 10, plunger 16, which can be easily constructed of a one piece plastic molding, includes a rod portion 43 having a finger loop 44 at one end and six integral spherical obstructions 44, 45, 46, 47, 48 and 49.

Figure 3:
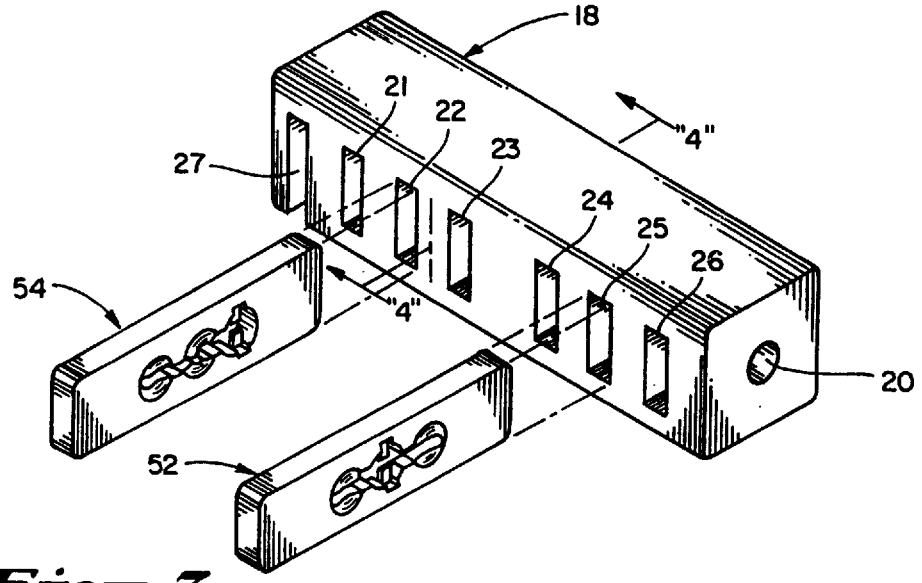
FIG. 3 is an exploded perspective illustrating the one piece lock housing with one of each of the two standard blocking slides.
Figure 4:
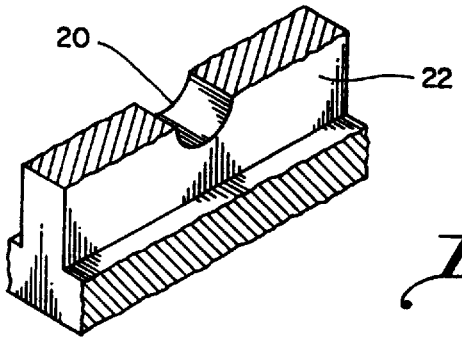
FIG. 4 is a fragmentary section of the housing taken generally along line 4—4 of FIG. 3.
Figure 5:
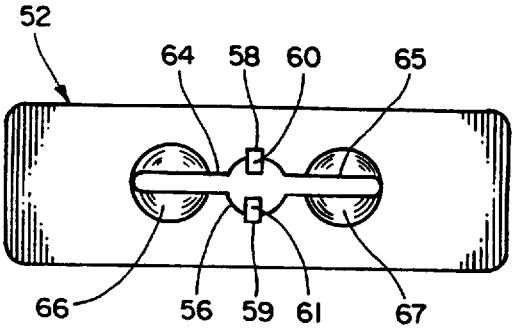
FIG. 5 is a side view of one of the standard blocking slides.
Figure 6:
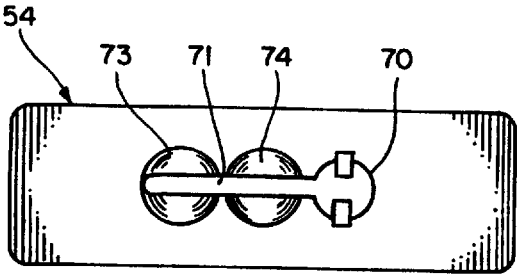
FIG. 6 is a side view of the other standard blocking slide.

Two standard blocking slides 52 and 54 are illustrated respectively in FIGS. 5 and 6 (as well as FIG. 3). It should be understood that of the six slides in the exemplary embodiment illustrated, three take the form of slide 52 and three take the form of slide 54.

It should be understood as seen in FIGS. 3, 5 and 6, that the slides 52 and 54 are rectangular in configuration and identically configured on both sides of each so that the slides 52, 54 are reversible in slots 21 to 26.

Figure 7:
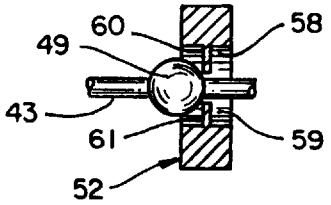
FIG. 7 is a cross section through one of the blocking slides taken through the passing aperture showing the spring finger positions.
Figure 8:
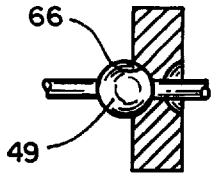
FIG. 8 is a cross section through the blocking slide in one of the blocking positions.

Each of the slides is a one piece rectangular plastic molding, and slide 52 includes a central through aperture 56 having a diameter slightly larger than spherical obstructions 44 to 49. Aperture 56 has upper and lower key-type slots 58 and 59 that have molded therein integral spring fingers 60 and 61 shown also in FIG. 7. The spherical projection 49 in FIG. 7 is illustrated in the lock position of the plunger, and in this position the spring fingers 60 and 61 engage one side of the obstruction 49. As a would-be lock picker pulls outwardly on plunger loop 44, obstruction 49, because of its engagement with spring fingers 60 and 61, shifts the slide very slightly laterally in its slot the same way the obstruction would shift the slide when in its blocking position illustrated in FIG. 8. In this way, regardless of whether the slide is in its blocking position or in its passing position, when the plunger is pulled axially, each of the slides will shift in their respective slots making it impossible for the lock picker to distinguish between slides in the locking position and slides in the blocking position.

However, fingers 60 and 61 are sufficiently flexible so they fold down in their adjacent recesses when plunger 16 is pulled with all the slides in the obstruction passing position, permitting the distal end 15 of the plunger to release tang 13.

Returning to FIG. 5, slide 52 has a pair of transverse slots 64 and 65 having a height somewhat greater than the rod portions 43 of the plunger that receive the rod portion in the two blocking positions of slide 52. The slide 52 has side recesses 66 and 67 at the ends of the slots (on both sides of the slides) that receive the spherical plunger projections when the slide is in its blocking position that provide the snap action movement of the slides when force is applied to the plunger (see FIGS. 8 and 17 for exemplary illustrations of the spherical projections when in the blocking recesses).

The blocking slide 54 has the same outer geometry as the slide 52 but rather than a central aperture has a side aperture 70 that passes projections 44 to 49 and a lateral slot 71 that passes plunger portion 43 and extends through the central position of the slide and the other side position. Recesses 73 and 74 are provided on both sides of the slide aligned with the two blocking positions of the slide and are identical in geometry to recesses 66 and 67 in slide 52.

Because both sides of slide 54 are identical, this slide can be reversed in the slots 21 to 26 to effect either right side blocking or left side blocking as desired thereby increasing the possible combinations of the lock without requiring the tooling for a third slide.

As seen in FIG. 17, plunger 44 is in its locked position and in this position the spherical projections 44 to 49 are either partly in one of the passing apertures 56 in slides 52 or 70 in slides 54, or in one of the blocking recesses 66, 67, 73, 74. The position of the loop 44 close to housing 18 holds the spherical projections 44 to 49 in either the blocking recesses or through apertures in the slides. However, there is still a small amount of play there-between.

In use, and in reference particularly to FIG. 17, assume that each of the blocking sides 52*a*, 52*b*, 52*c*, 54*a*, 54*b*, and 54*c* are in their plunger passing positions and that plunger 16 is partly withdrawn with its distal end 15 short of end slot 27. Gun case zipper 12 is then closed and its tang 13 positioned as shown, then plunger 44 is shifted to the left impaling the aperture in the zipper tang and moving the plunger to its locking position illustrated in FIG. 17.

Slides 52 and 54 are then all shifted away from the passing positions to one of the two blocking positions of each. Unlocking is, of course, effected by shifting each of the slides from one's memory or notes to its passing position. Because each of the blocking slides has only three positions and these positions are distinct, it is relatively easy to memorize the lock combination and also relatively easy for the lock user to unlock the lock from memory simply by "feeling" the position of the slides even in the dark.

The lock combination can be changed by either switching one or more slides 52 with one or more slides 54 or by rotating one or more slides 54 180 degrees in its slot as noted above.

FIG. 18 illustrates an alternative form of the present invention and is exemplified as a combination padlock, and is seen to include a rectangular padlock housing 80 having a main bore 82 there-through and a secondary bore 83 extending partly there-through that receives a distal end 84 of a U-shaped portion 85 of plunger 86. The housing 81 has a plurality of transverse slots 87 there-through that receive a plurality of blocking slides 89 that effect selective blocking of spherical obstructions 90 formed on the plunger 86.

The portion of the plunger 86 slidable in main passage 82 is identical to the corresponding portion of plunger 16 in the FIGS. 1 to 17 embodiment and blocking slides 89 are identical to blocking slides 52 and 54 also illustrated with respect to the FIG. 17 embodiment. The plunger 86 and U-shaped portion 85 are rotatable in housing main passage 82 to effect the desired swiveling motion in a padlock and, of course, the symmetrical shape of the plunger portion in bore 82 and the spheroidal configuration of obstructions 90 conveniently accommodate the desired pivotal, as well as reciprocal, motion of U-shaped plunger portion 85 as distal end 84 moves in and out of secondary passage 83 and swivels toward and away from the lock body 81.

Referring to FIGS. 19 to 22, which illustrate an alternative embodiment 110 of the present tamper resistant lock assembly, it should be understood that this lock operates in substantially the same manner as the lock illustrated in FIGS. 1 to 17, as well as the lock illustrated in FIG. 18, in the drawings. Lock assembly 110 includes a block-like housing 111 consisting of a lower housing half 112 and an upper housing half 113, that are locked together by inter-engaging projections 116 that in upper housing half 111 lock into recesses not shown in lower housing half 112.

The lock 110 is held in position on its associated case by a backing plate 118 that fits within the case, held in position by a plurality of fasteners 120 and 121 that extend through lower housing half apertures 124 and are threaded into apertures 125 in the upper housing half 113 to not only lock the entire lock assembly in position but also to lock the housing halves together in a tamper resistant fashion because fasteners 120 and 121 are inside the locked case.

Figure 19:
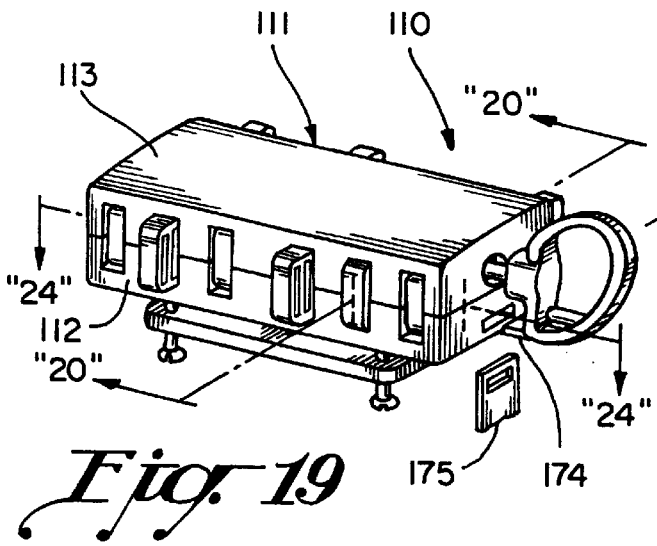
FIG. 19 is a perspective view of another embodiment of the present tamper resistant lock assembly.
Figure 22:
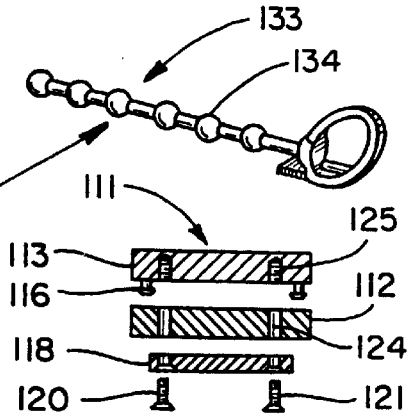
FIG. 22 is an exploded view of the tamper resistant lock assembly illustrated in FIG. 19.
Figure 20:
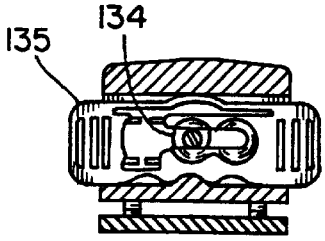
FIG. 20 is a cross-section taken generally along line 20—20 of FIG. 19 with a side pass slide therein.
Figure 21:
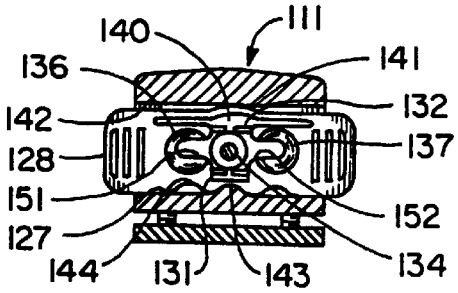
FIG. 21 is a cross-section generally similar to FIG. 20 with a central pass slide therein.

As seen in FIG. 21, which is an enlarged cross-section through FIG. 19, the housing 111 has through slots 127 that correspond with the slots in the FIGS. 1 to 17 embodiment, and each receive a central pass slide member 128, which function in a similar way to the slides shown in the FIGS. 1 to 17 embodiments. Slide 128 has a central aperture 131 having a diameter greater than the spheroidal blocking obstructions 134 on the plunger 133 to permit the plunger to be withdrawn when the slide 128 is in its central passing position. As in the FIGS. 1 to 17 embodiment, the passing aperture 131 is positioned in second slides 135 shown in FIG. 20, in one of the side apertures as opposed to the central aperture. The slide 128 has four flexible fingers 132 that are positioned on a diameter less than the diameter of spheroidal obstructions 134 to interfere with the obstructions 134 and function in the same way as fingers 60 and 61 illustrated in FIG. 5 to effect shifting of the slides 128 and 135 as the lock picker tugs on the plunger 133 to simulate a blocking position of the slides 128 and 135 when in fact they are in the passing position. Fingers 132 move radially with respect to the axis of the plunger 133 as opposed to the general axial bending movement of the fingers 60 and 61 in the FIG. 5 embodiment.

The two side positions of the slides 128 are defined by spheroidal recesses 136 and 137 that partly receive the end of the projections 134 to provide the snap action movement of the slides 128 when tension is applied to the plunger 133 in a manner similar to the FIGS. 1 to 17 embodiment. The depth of the recesses 136 and 137 is selected so that the plunger obstructions 134 engage the bottom of the recesses 136 and 137 with the same axial movement of the plunger 133 as when the plunger obstructions 134 engage the fingers 132.

The aperture 131 in FIG. 21 is contiguous with side slots 151 and 152 and they permit the slides to be shifted to their side positions aligning one of the spheroidal recesses 136 and 137 with the axis of plunger 133.

As with the FIGS. 1 to 17 embodiment, the snap action movement of the slide 128 to its three positions is achieved with tension being applied to the plunger 133 engaging the obstructions 134 in the recesses 136 and 137 or against the fingers 132, and as the slide 128 is shifted with that tension being applied, the user or lock picker can feel the snap action movement of the slides 128. The same is true of the slides 135.

According to the FIGS. 19 to 21 embodiment, means are provided to prevent the slides 128 and 135 from falling out of the housing 111 when the plunger 133 is completely withdrawn. Toward this end, a slot 140 is provided in the slides 128 and 135 that defines an upwardly arching integral leaf spring 141 that engages the upper surface 142 of slot 127 to continuously bias slides 128 and 135 downwardly toward the bottom of the slots 127. The bottom of each of the slots 127 has an axial projection 143 that selectively engages one of three recesses 144 to hold the slides in one of its three capable positions.

Figure 23:
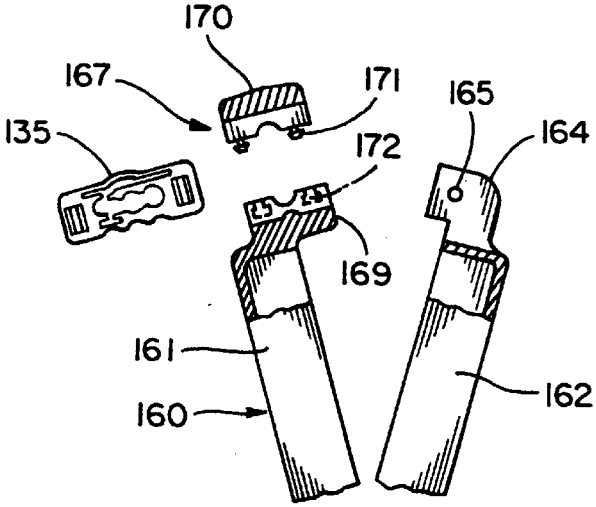
FIG. 23 is a partly fragmented section of a clamshell hard plastic case with the present tamper resistant lock assembly formed in part integrally therewith.
Figure 24:
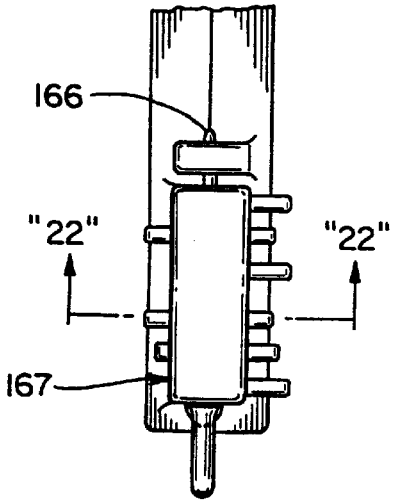
FIG. 24 is a top view of the tamper resistant lock assembly shown in FIG. 23.

In FIGS. 23 and 24, a clamshell-type rigid plastic case 160 is illustrated having case halves 161 and 162 that close together from the position shown in FIG. 23 to the top view closed position illustrated in FIG. 24. Case half 162 has an integral tang 164 with an aperture 165 therein, that receives a plunger 166 on lock assembly 167 that locks the case halves 161 and 162 together.

Lock assembly 167 consists of a lower housing half 169 that mates with an upper housing half 170 connected together by interlocking male and female projections 171 and 172. Housing halves 169 and 170 can also be connected together by tamper proof fasteners that extend from inside the case 160 in a similar fashion to fasteners 120 and 121 illustrated in FIG. 22. An important aspect of the lock 167 is that the lower housing half 169 is molded integrally with case half 161 providing not only an extremely low cost lock assembly, but one that is cosmetically attractive in the sense that it appears more integrated with the case 160.

Referring to FIGS. 25 to 30 wherein a trigger blocking device 210 is illustrated, it should be understood that the details of the indexible slides, and the operation of the combination locks illustrated herein, are identical to those shown and described in reference to FIGS. 1 to 24, and hence are incorporated by reference into the FIGS. 25 to 30 embodiment.

Viewing FIGS. 25 to 30, the tamper resistant blocking device 210 is seen to include a first blocking member assembly 211 and a second blocking member assembly 212. The blocking member assembly 211 is seen to include an ellipsoidal blocking member portion 214 that has the general configuration of a trigger guard, such as the trigger guard illustrated in FIG. 29. It should be understood, however, that the blocking member assemblies 211 and 212 are intended to fit over a variety of sized trigger guards so that they may overlap the trigger guard to a greater extent, in some models, than illustrated in FIG. 29 to accommodate a variety of trigger guards. It may also be desirable that the tamper resistant blocking device 210 be provided in a variety of sizes, however, to accommodate significantly different trigger guard configurations. The forward surface of the blocking member portion 214 is preferable rubberized to grip the sides of the trigger guard and possibly portions of the weapon receiver immediately above the trigger guard. The blocking assembly 211 further includes a combination lock 213 similar to that described with reference to FIGS. 1 to 24, having three indexible slides 215 slidable in slots 216 in block body 217. A central aperture 219 (FIG. 28) is provided intersecting the slots 216 that receives a plunger 220 carried by blocking device 212 having a plurality of obstructions 221 thereon.

Figure 28:
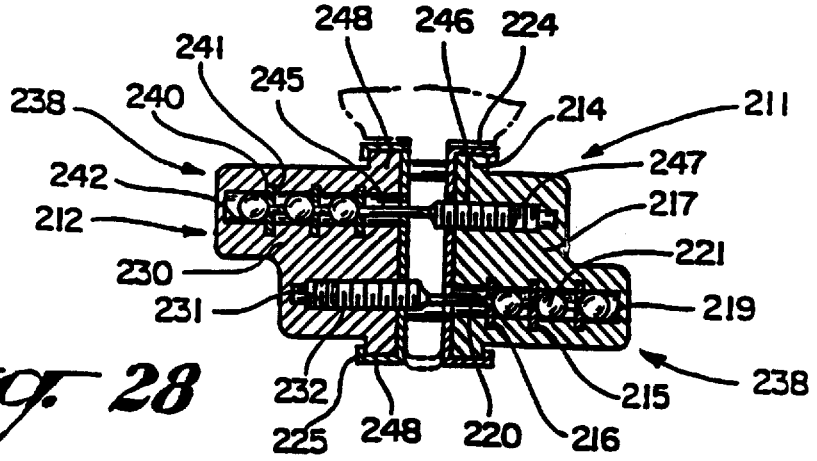
FIG. 28 is a longitudinal section through the assembled trigger blocking device taken generally along line 28—28 of FIGS. 26 and 27.

As seen in FIG. 28, the rubberization of the forward surface of the blocking member portion 214 is achieved by a Neoprene "sock" 224 that has a flange 225 that fits over the rear of blocking member portion 214. As seen in FIG. 28, the housing 217 and the blocking member portion 214 are one piece. The sock 224, and principally its resilient forward surface, enables the members 213 and 212 to be squeezed against the sides of the trigger guard as the combination locks 213 and 238 are engaged. Also, the sock minimizes scratching the weapon.

The trigger blocking member 212 is similar to trigger blocking member 211 except several of the parts are vertically reversed; i.e., rotated 180 degrees. Blocking member 212 includes a housing 230 having a lower threaded bore 231 that receives a threaded shank portion 232 of the plunger 220 that forms part of the locking mechanism for combination lock 213 associated with blocking member assembly 211. Blocking member 212 includes a second combination lock 238 vertically above and in the same vertical plane as combination lock 213. Combination lock 238 is simply a reversal of combination lock 213 and includes three blocking slides 240 in cross slots 241 which intersect a main passage 242 that receives a plunger 245 identical to plunger 220 having the same obstructions and a threaded shank portion 246 threadedly received in a threaded bore 247 formed in housing 217 of blocking member assembly 211. A Neoprene sock 248 identical to Neoprene sock 224 covers the blocking member portion 248 integral with and defining the forward part of housing 230.

The present tamper resistant blocking assembly 210 includes a system of indexible rods for minimizing lateral movement of the assembly with respect to the trigger guard, and also is effective to lock the trigger itself in position to prevent the discharge of the weapon if dropped on the ground with the blocking device 210 in position.

Figure 25:
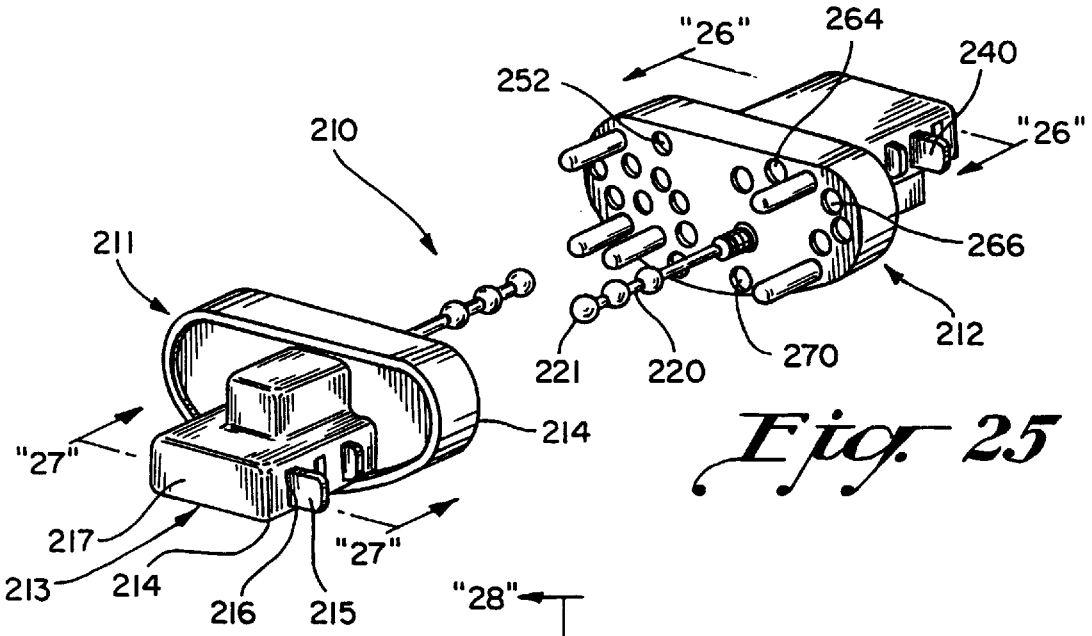
FIG. 25 is an exploded perspective of the present tamper resistant trigger blocking device.
Figure 26:
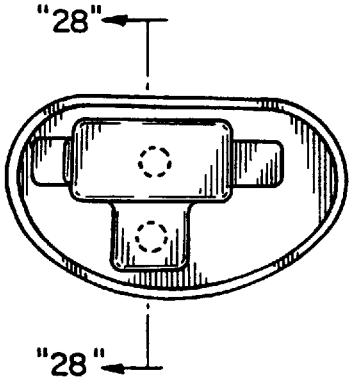
FIG. 26 is a right side view of the trigger blocking device illustrated in FIG. 25.
Figure 27:
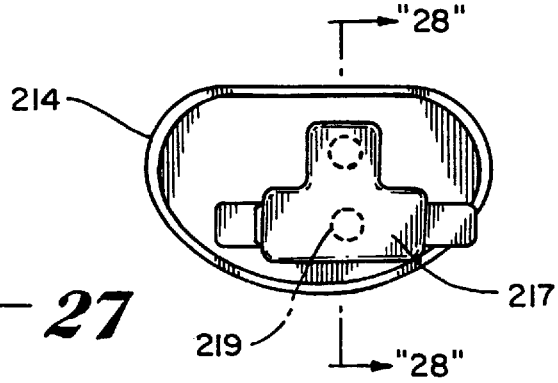
FIG. 27 is a left side view of the trigger blocking device illustrated in FIGS. 25 and 26.
Figure 29:
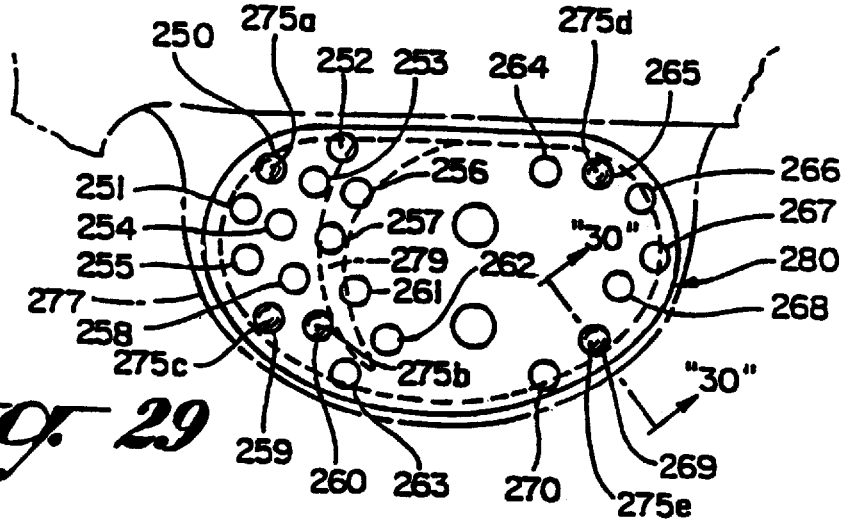
FIG. 29 is a right side view of the right half of the trigger blocking device shown assembled into a phantom trigger guard.
Figure 30:
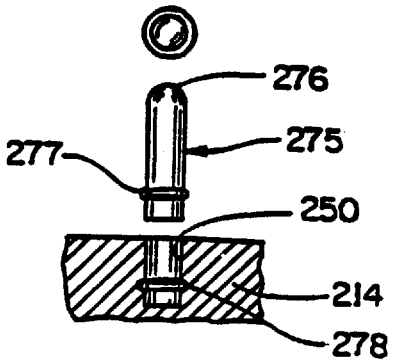
FIG. 30 is a fragmentary section through one of the indexible rods, taken generally along line 30—30 of FIG. 29.

Toward this end and as seen in FIGS. 25 and 29, there are a plurality of bores 250 to 270 strategically arranged in the forward portion of the housing 230. Housing 217 has a similar plurality of bores (not shown) arranged in mirror image and aligned with bores 250 to 270. A plurality of indexible and removable rods 275 are selectively received in bores 250 to 270 having their distal ends supported in the complementary bores in housing 217 when assembled on the weapon. The rods 275 have spheroidal forward ends 276 and integral proximal rings 277 that snap into recesses 278 in each of the bores 250, etc. to hold the rods 275 in position. Rods 275 are one piece plastic injection moldings or plastic coated metal.

The positioning of the bores 250 to 270 is strategic to adapt the blocking assembly 210 to accommodate a wide variety of housing and trigger configurations. The bores 251, 253, 255, 259, 254, 258, and 263 are adapted to selectively receive rods 275 for engagement with either side of the rear portion 277 of the trigger guard. Bores 250, 252, 264 and 265 are positioned to selectively receive rods 275 to engage the lower portion of the receiver housing. Bores 256, 257, 258, 261, 260 and 262 are adapted to receive rods 275 to engage the rear of trigger 279 to prevent trigger actuation. Lastly, bores 266, 267, 268, 269 and 270 are positioned to receive rods 275 to engage the forward portion 280 of the trigger guard. In this regard it should be understood that while the bores 250, etc. shown in FIG. 29 are positioned mostly within the specific trigger guard illustrated so pins 275 engage the inner surface of the trigger guard, in weapons having smaller trigger guards than the trigger guard illustrated in FIG. 29, some of the pins 275 may fall outside of the trigger guard and can receive pins 275 to engage the outside of the guard. That is in some cases, the pins 275 can be positioned on both sides of the trigger guard rather than simply on the inside shown in FIG. 29.

For the trigger guard shown in FIG. 29, the user would select bore 250 to receive rod 275*a* to engage the lower part of the receiver, he would position a pin 275*c* in bore 259 to engage the inner surface of the rear portion 277 of the trigger guard, he would position rod 275*c* in bore 260 to engage the rear of the trigger 279 to prevent inadvertent triggering, he would position rod 275*d* in bore 265 to engage the forward lower surface of the receiver, and he would position rod 275*e* in bore 269 to engage the inner surface of the forward portion 280 of the trigger guard.

While the appropriate positioning of the rods 275 in the bores 250, etc., may seem complex, in actuality the user task is fairly simple. The user simply places the trigger blocking assembly 212 adjacent one side of the trigger guard without the opposite blocking assembly 211 in place. He then essentially sees what is viewed in FIG. 29. In this position the rods 275 can be easily inserted into the appropriate bores 250, etc. to achieve a locking configuration. Once this task is achieved, it is unnecessary for the rods 275 to be repositioned except when the blocking assembly 210 is to be adapted to a different weapon.

To assure that the blocking assemblies 211 and 212 are held firmly against the trigger guard, the user axially adjusts the plungers 220 and 245 to a position where the obstructions 221 are appropriately tensioned by the slides 215 and 240. Once this adjustment is made, it is unnecessary for the user to make further changes unless it is desired that the blocking assembly be used for a different weapon.

We claim:

1. A tamper resistant trigger blocking device for a weapon having a trigger depending from a weapon housing and trigger guard surrounding in part the trigger, comprising: a first blocking member adapted to extend over one side of the trigger guard, a second blocking member adapted to extend over the other side of the trigger guard, and means for releasably connecting the first and second blocking members together and against the opposite sides of the trigger guard including a combination lock having a main passage in one of the blocking members intersected by a plurality of cross slots, a plunger carried by the other blocking member slidable in the main passage having a plurality of obstructions thereon, a plurality of generally planar blocking slides reciprocal in the cross slots having aperture means generally centrally therethrough receiving the plunger movable to at least two indexible positions relative to the plunger, one in which the plunger obstructions are blocked by the slides and one in which the plunger obstructions may pass through the aperture means, whereby the blocking members are held together and released by the combination lock.

2. A tamper resistant trigger blocking device as defined in claim 1, wherein there is a second combination lock including a second main passage in other blocking members intersected by a plurality of second cross slots, a second plunger carried by the one blocking member and slidable in the second main passage having a plurality of obstructions thereon, a plurality of generally planar second blocking slides reciprocal in the second cross slots having aperture means generally centrally therethrough receiving the second plunger movable to at least two indexible positions relative to the second plunger, one in which the second plunger obstructions are blocked by the second slides and one in which the second plunger obstructions may pass through the aperture means, whereby by providing one combination lock on one side of the trigger guard and a second combination lock on the other side of the trigger guard the extent of projection of the blocking device from the mechanism is minimized.

3. A tamper resistant trigger blocking device as defined in claim 1, including means for adjusting the clamping forces of the first and second blocking members on the trigger guard.

4. A tamper resistant trigger blocking device as defined in claim 3, wherein the means for adjusting the clamping force of the blocking members includes means for axially adjusting the plunger with respect to the other blocking member.

5. A tamper resistant trigger blocking device as defined in claim 3, wherein the plunger is threadedly received in the other blocking member to define the means for adjusting the clamping force of the blocking members.

6. A tamper resistant trigger blocking device as defined in claim 1, wherein said indexible positions are defined by cooperating means on the slides that provide a snap action movement as the slides are moved from one indexible position to the next, said plunger being movable through the block slides in a direction perpendicular to the block slides, and means to minimize lock picking including means on the slides engageable with the plunger obstructions when the slides are in the obstructions pass position that cause the slides to shift slightly in the housing slots as pressure is applied to the plunger.

7. A tamper resistant trigger blocking device as defined in claim 6, wherein the slides have at least three indexible positions relative to the plunger, one in which the plunger may pass and two in which the plunger is blocked.

8. A tamper resistant trigger blocking device as defined in claim 7, wherein the slides are standardized into two configurations including a first plurality of identical slides having a central aperture that passes the obstructions and two side apertures that block the obstructions, and a second plurality of identical slides having a side aperture that passes the obstructions and central and other side apertures that block the plunger obstructions.

9. A tamper resistant trigger blocking device as defined in claim 8, wherein said second plurality of slides are each reversible in the housing slots to effect three passing positions of the slides with only two standard slides.

10. A tamper resistant trigger blocking device for a weapon having a trigger depending from a weapon housing and trigger guard surrounding in part the trigger, comprising: a first blocking member adapted to extend over one side of the trigger guard, a second blocking member adapted to extend over the other side of the trigger guard, and means for releasably connecting the first and second blocking members together and against the opposite sides of the trigger guard, and means to minimize movement of the blocking members with respect to the trigger guard in an axial direction with respect to the weapon for a variety of different sized trigger guards including a plurality of rods carried by one blocking member engageable with the guard, said rods being indexible by the user into different positions on the one blocking member to engage the trigger guard and minimize movement of the blocking device in the plane of the trigger guard.

11. A tamper resistant trigger blocking device as defined in claim 10, wherein the one blocking member has a substantial number of apertures therein selectively receiving and locking the rods therein, said other blocking member having a plurality of bores therein that are equal in number and in axial alignment with the apertures in the one blocking member.

12. A tamper resistant trigger blocking device as defined in claim 11, wherein the rods have a quick release snap lock connection with the apertures in the one blocking member.

13. A tamper resistant trigger blocking device for a weapon having a trigger depending from a weapon housing and trigger guard surrounding in part the trigger, comprising: a first blocking member adapted to extend over one side of the trigger guard, a second blocking member adapted to extend over the other side of the trigger guard, and means for releasably connecting the first and second blocking members together and against the opposite sides of the trigger guard including a combination lock having a main passage in one of the blocking members intersected by a plurality of cross slots, a plunger carried by the other blocking member slidable in the main passage having a plurality of obstructions thereon, a plurality of generally planar blocking slides reciprocal in the cross slots having aperture means generally centrally therethrough receiving the plunger movable to at least two indexible positions relative to the plunger, one in which the plunger obstructions are blocked by the slides and one in which the plunger obstructions may pass through the aperture means, whereby the blocking members are held together and released by the combination lock, and means to minimize movement of the blocking members with respect to the trigger guard in an axial direction with respect to the weapon for a variety of different sized trigger guards including a plurality of rods carried by one blocking member and engageable with the guard, said rods being indexible by the user into different positions on the one blocking member to engage the trigger guard and minimize movement of the blocking device in the plane of the trigger guard.

14. A tamper resistant trigger blocking device for a weapon having a trigger depending from a weapon housing and trigger guard surrounding in part the trigger, comprising: a first blocking member adapted to extend over one side of the trigger guard, a second blocking member adapted to extend over the other side of the trigger guard, and means for releasably connecting the first and second blocking members together and against the opposite sides of the trigger guard including a combination lock having a main passage in one of the blocking members intersected by a plurality of cross slots, a plunger carried by the other blocking member slidable in the main passage having a plurality of obstructions thereon, a plurality of generally planar blocking slides reciprocal in the cross slots having aperture means generally centrally therethrough receiving the plunger movable to at least two indexible positions relative to the plunger, one in which the plunger obstructions are blocked by the slides and one in which the plunger obstructions may pass through the aperture means, whereby the blocking members are held together and released by the combination lock, and a second combination lock including a second main passage in the other blocking member intersected by a plurality of second cross slots, a second plunger carried by the one blocking member and slidable in the second main passage having a plurality of obstructions thereon, a plurality of generally planar second blocking slides reciprocal in the second cross slots having aperture means generally centrally therethrough receiving the second plunger movable to at least two indexible positions relative to the second plunger, one in which the second plunger obstructions are blocked by the second slides and one in which the second plunger obstructions may pass through the aperture means, whereby by providing one combination lock on one side of the trigger guard and a second combination lock on the other side of the trigger guard the extent of projection of the blocking device from the mechanism is minimized.

15. A tamper resistant trigger blocking device for a weapon having a trigger depending from a weapon housing and trigger guard surrounding in part the trigger, comprising: a first blocking member adapted to extend over one side of the trigger guard, a second blocking member adapted to extend over the other side of the trigger guard, and means for releasably connecting the first and second blocking members together and against the opposite sides of the trigger guard including a combination lock having a main passage in one of the blocking members intersected by a plurality of cross slots, a plunger carried by the other blocking member slidable in the main passage having a plurality of obstructions thereon, a plurality of generally planar blocking slides reciprocal in the cross slots having aperture means generally centrally therethrough receiving the plunger movable to at least two indexible positions relative to the plunger, one in which the plunger obstructions are blocked by the slides and one in which the plunger obstructions may pass through the aperture means, whereby the blocking members are held together and released by the combination lock, and means for adjusting the clamping force of the blocking members including means for axially adjusting the plunger with respect to the other blocking member.

* * * * *